US010215013B2

(12) United States Patent
Collins

(10) Patent No.: US 10,215,013 B2
(45) Date of Patent: Feb. 26, 2019

(54) REAL TIME DOWNHOLE SENSOR DATA FOR CONTROLLING SURFACE STIMULATION EQUIPMENT

(75) Inventor: Brett R. Collins, Humble, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 1083 days.

(21) Appl. No.: 13/293,295

(22) Filed: Nov. 10, 2011

(65) Prior Publication Data

US 2013/0118739 A1 May 16, 2013

(51) Int. Cl.

| | |
|---|---|
| ***E21B 47/01*** | (2012.01) |
| ***E21B 43/26*** | (2006.01) |
| ***E21B 43/267*** | (2006.01) |
| *E21B 43/25* | (2006.01) |

(52) U.S. Cl.

CPC ..... *E21B 47/01* (2013.01); *E21B 43/267* (2013.01); *E21B 43/25* (2013.01); *E21B 43/26* (2013.01)

(58) Field of Classification Search

CPC ..... E21B 43/25; E21B 43/06; E21B 43/267; E21B 47/01; E21B 43/26

USPC ..... 166/208.1, 280.2, 305.1, 275; 702/6

See application file for complete search history.

(56) References Cited

U.S. PATENT DOCUMENTS

| | | | | |
|---|---|---|---|---|
| 6,776,235 | B1 | 8/2004 | England | |
| 6,795,773 | B2 * | 9/2004 | Soliman et al. | 702/6 |
| 6,978,831 | B2 * | 12/2005 | Nguyen | 166/250.01 |
| 7,044,220 | B2 | 5/2006 | Nguyen et al. | |
| 7,140,437 | B2 * | 11/2006 | McMechan et al. | 166/278 |
| 7,178,596 | B2 | 2/2007 | Blauch et al. | |
| 7,228,904 | B2 | 6/2007 | Todd et al. | |
| 7,369,979 | B1 | 5/2008 | Spivey | |
| 7,451,812 | B2 * | 11/2008 | Cooper et al. | 166/250.1 |
| 7,806,182 | B2 | 10/2010 | Waters et al. | |
| 7,938,185 | B2 | 5/2011 | Smith et al. | |
| 2005/0263281 | A1 | 12/2005 | Lovell et al. | |
| 2006/0102345 | A1 | 5/2006 | McCarthy et al. | |
| 2009/0107671 | A1 | 4/2009 | Waters et al. | |
| 2009/0283259 | A1 * | 11/2009 | Poitzsch et al. | 166/250.01 |
| 2010/0224365 | A1 * | 9/2010 | Abad | 166/275 |

FOREIGN PATENT DOCUMENTS

| | | | |
|---|---|---|---|
| WO | 0323188 | A1 | 3/2003 |
| WO | 2009094066 | A2 | 7/2009 |

OTHER PUBLICATIONS

European Examination Report; European Patent Application No. 12847865.8 (2776674); pp. 1-5.

* cited by examiner

*Primary Examiner* — Waseem Moorad
*Assistant Examiner* — Christopher J Sebesta
(74) *Attorney, Agent, or Firm* — Cantor Colburn LLP

(57) ABSTRACT

A system, method and apparatus for stimulating a reservoir is disclosed. A slurry is supplied to the work string at the surface, which work string extends from the surface location to a downhole location adjacent the reservoir. A parameter of the slurry is measured at the downhole location and transmitted to the surface location. A control unit at the surface location receives the measured parameter of the slurry and estimates a fracture conductivity of the reservoir using the measured parameter of the slurry. The control unit may alter the parameter of the slurry at the surface location to obtain a selected fracture conductivity to stimulate the reservoir.

15 Claims, 2 Drawing Sheets

REAL TIME DOWNHOLE SENSOR DATA FOR CONTROLLING SURFACE STIMULATION EQUIPMENT

BACKGROUND OF THE DISCLOSURE

1. Field of the Disclosure

The present disclosure is related to methods and apparatus for stimulating a reservoir.

2. Description of the Related Art

Various calculations are performed in stimulation operations to estimate a production rate that will result from the stimulation operation. One key to estimating the resulting production rate is determining fracture conductivity, which depends on various downhole parameters such as fluid injection rate, fluid pressure, and proppant concentration in a fracture fluid ("frac fluid") during the stimulation operation. Current models for determining the fracture conductivity assume knowledge of the value of these parameters at the downhole location of a formation fracture. However, these downhole parameters are typically calculated by measuring the parameters at a surface location and performing calculations to determine the value of the parameter at the downhole location. For various reasons, determining downhole parameters from surface measurements is unreliable and leads to poor calculations of fracture conductivity. The present disclosure therefore provides a method and apparatus for controlling the downhole parameters to align actual fracture conductivity with a selected fracture conductivity

SUMMARY OF THE DISCLOSURE

In one aspect, the present disclosure provides a method of stimulating a reservoir, including: injecting a slurry into a work string at a surface location, wherein the work string extends from the surface location to a downhole location adjacent the reservoir; measuring a parameter of a slurry at the downhole location; estimating a fracture conductivity of the reservoir using the measured parameter of the slurry at the downhole location; and altering the parameter of the slurry at the surface location to obtain a selected fracture conductivity at the reservoir to stimulate the reservoir.

In another aspect, the present disclosure provides an apparatus for stimulating a reservoir, including: a work string configured to extend from a surface location to a downhole location adjacent the reservoir; a device configured to provide a slurry into the work string at the surface location; a sensor at the downhole location configured to measure a parameter of the slurry at the downhole location; and a control unit configured to estimate a fracture conductivity of the reservoir using the measured parameter of the slurry and to alter the parameter of the slurry at the device to obtain a selected fracture conductivity at the reservoir to stimulate the reservoir.

In another embodiment, the present disclosure provides a completion system, including: a work string configured to extend from a surface location to a downhole location adjacent the reservoir; a device configured to provide a slurry into the work string at the surface location; a sensor at the downhole location configured to measure a parameter of the slurry at the downhole location; and a control unit configured to estimate a fracture conductivity of the reservoir using the measured parameter of the slurry and alter the parameter of the slurry at the device to obtain a selected fracture conductivity at the reservoir to stimulate the reservoir.

Examples of certain features of the apparatus and method disclosed herein are summarized rather broadly in order that the detailed description thereof that follows may be better understood. There are, of course, additional features of the apparatus and method disclosed hereinafter that will form the subject of the claims.

BRIEF DESCRIPTION OF THE DRAWINGS

For detailed understanding of the present disclosure, references should be made to the following detailed description, taken in conjunction with the accompanying drawings, in which like elements have been given like numerals and wherein.

DETAILED DESCRIPTION OF THE DISCLOSURE

Figure 1:
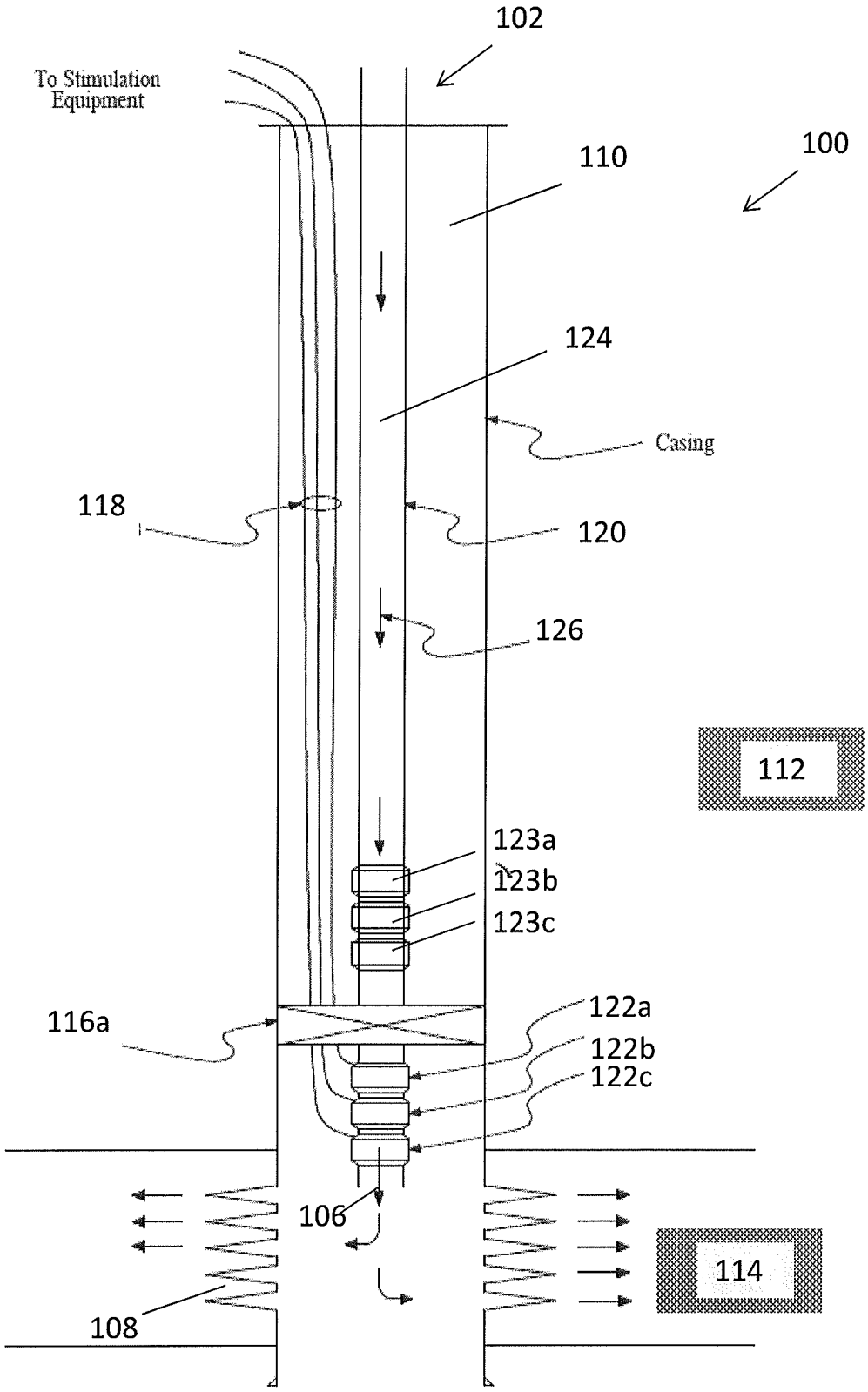
FIG. 1 shows an exemplary downhole system for use in a stimulation operation according to an exemplary embodiment of the present disclosure.

FIG. 1 shows an exemplary downhole system 100 for use in a stimulation operation according to an exemplary embodiment of the present disclosure. The system of FIG. 1 is typically a stimulation system, but can be any system used in delivery of a slurry including one or more of fracture fluid (frac fluid), proppant, sand, acid, etc. to a downhole location. A proppant can be naturally occurring sand grains or man-made proppants such as resin-coated sand or high-strength ceramic materials like sintered bauxite. The stimulation system typically includes various equipment for controlling various parameters of a slurry pumped downhole. Exemplary parameters may include injection rate, pressure, proppant concentration, viscosity, pH, density, among others.

The exemplary downhole system 100 includes a work string 120 extending downward from a surface location 102 into a borehole 110 in an earth formation 112. In various embodiments, the work string 120 can be a wired pipe and/or a drill pipe that is configured to convey various equipment downhole for performing downhole aspects of the stimulation operation. The work string generally extends from the surface location to a reservoir 114 at the downhole location. The work string 120 generally defines an internal axial flowbore 124 along its length. During typical operations, the work string delivers a slurry 126 that includes fracturing or stimulation fluids and/or proppants from the surface location to a downhole location proximate the reservoir 114 via the flowbore 124. A frac head (see FIG. 2) is generally coupled to a top end of the work string 120 at the surface location. The frac head is configured for injection of the slurry into the work string at the surface location. An opening 106 at a bottom end of the work string delivers the slurry to the downhole location. The work string may also convey equipment (not shown) downhole for controlling the delivery of the slurry at the downhole location.

In an exemplary embodiment, one or more packers 116 may be used to isolate the reservoir 114 prior to delivery of the slurry downhole. The packers seal the borehole 110 at one or more locations to isolate a region of the borehole and the reservoir. The reservoir in the isolated region typically includes one or more perforations 108 extending into the reservoir 114 that are typically produced from previous operations. In the exemplary system of FIG. 1 only one packer is shown at a location above the reservoir 114. In another embodiment, a second packer may be activated at a location below the reservoir 114 to isolate the reservoir. The packer is typically conveyed downhole on an exterior portion of the work string and is activated to expand when it reaches a selected depth to seal the borehole. Once the reservoir is sealed, slurry may be introduced downhole at the isolated region and into the reservoir to extend the perforations 108. In alternate embodiments, the work string may include multiple openings for delivery of frac fluid at multiple reservoir layers. The one or more openings can be located in a vertical section, a deviated section or both a vertical and deviated section of a borehole.

The work string 120 further includes one or more sensors 122*a*, 122*b* and 122*c* (referred to collectively as sensors 122) coupled to the work string to measure a downhole parameter of the slurry. Typically the sensors are coupled to the work string in the isolated region of the borehole (i.e, below packer 116) and near opening 106 so that the property of the slurry is measured immediately prior to its delivery into the reservoir. In one embodiment, the sensors 122 measure the parameter of the slurry while the slurry is in the work string. Alternatively, the one or more sensors can be at a selected nearby location, such as outside of the isolated borehole region (i.e., above packer 116) as shown in sensors 123*a*, 123*b* and 123*c*. In various embodiments, a single sensor can be used to measure the various parameters of the slurry. Exemplary sensors 122 include a density sensor 122*a* for measuring a downhole density of the slurry, a pressure sensor 122*b* for measuring a downhole pressure of the slurry, and an injection rate sensor 122*c* for measuring a downhole injection rate of the slurry. Additional sensors can also be disposed downhole to measure additional parameters of the slurry, such as pH, viscosity, temperature, strain, flow, etc. The sensors typically provide measurements updated every few milliseconds. One or more fiber optic cables 118 are coupled to the downhole sensors 122 to deliver signals related to the downhole measurements from the downhole sensors 122 to the surface location 102. In one embodiment, the fiber optic cable 118 can be built into the work string. Alternatively, the fiber optic cables 118 may be disposed exterior to the work string.

Figure 2:
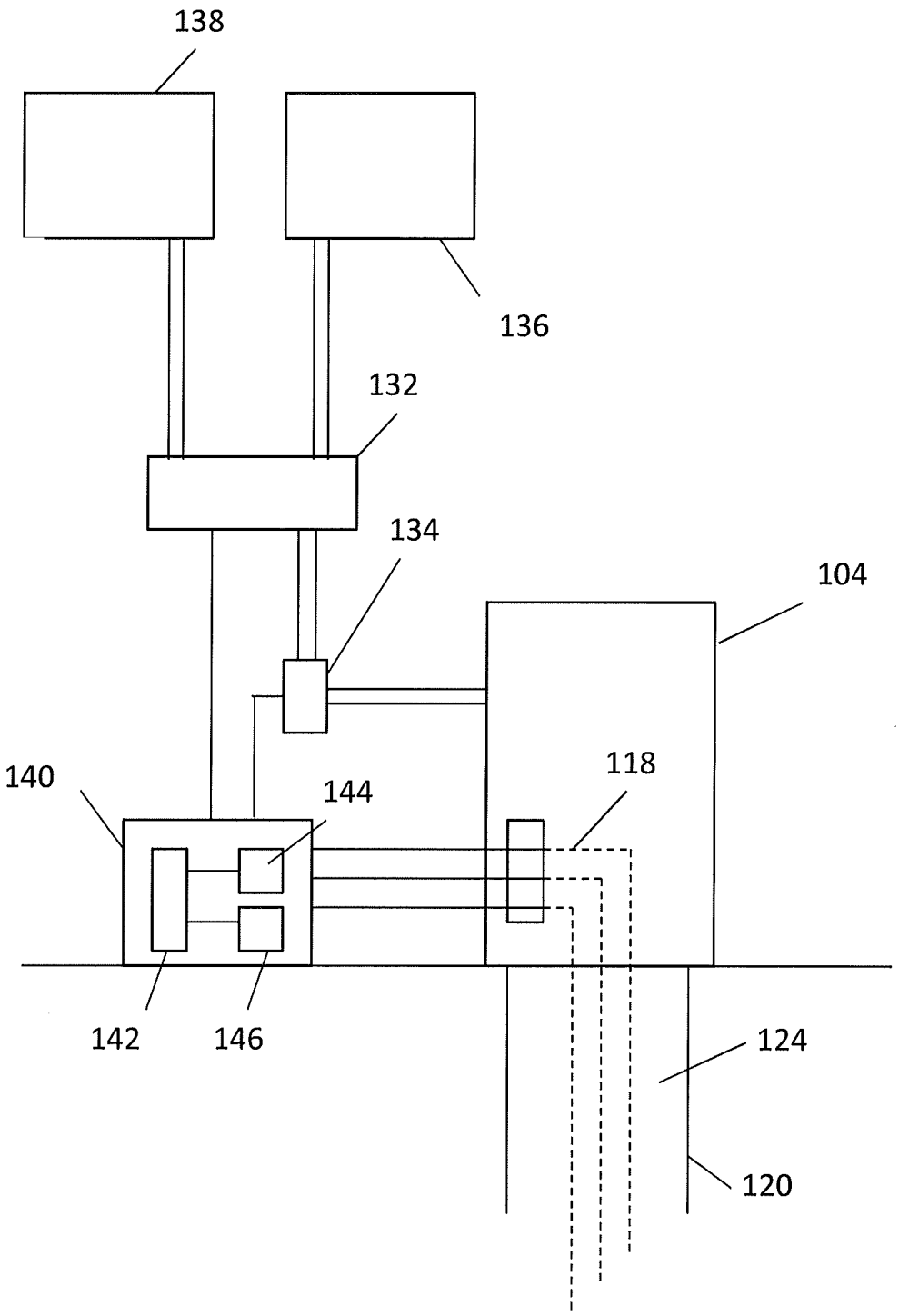
FIG. 2 shows various devices at a surface location for use with the exemplary system of FIG. 1 to perform a stimulation operation according to exemplary methods of the present disclosure.

FIG. 2 shows various devices at the surface location 102 for use with the exemplary work string of FIG. 1 to perform stimulation operations according to the exemplary methods disclosed herein. The various surface devices include the frac head 104, a frac fluid storage unit 138, a proppant storage unit 136, a mixing unit 132, and a pump or injection unit 134. The frac fluid storage and proppant storage unit includes frac fluid and proppant respectively for use in the stimulation operation of the present disclosure. The mixing unit 132 is configured to receive frac fluid from the frac fluid storage unit 138 and proppant from the proppant storage unit 136 and mix the frac fluid and proppant to form a slurry having a selected composition, density and/or concentration, for example. The pump 134 is configured to receive the slurry from the mixing unit 132 and to pump the slurry into the frac head and into the flowbore 124 of the work string 120 at a selected injection rate and/or pressure. Fiber optic cables 118 provide sensor measurements of the parameter of the slurry from downhole sensors 122 to a control unit 140 at the surface location.

The control unit 140 typically includes a processor 142, one or more computer programs 144 that are accessible to the processor 142 for executing instructions contained in such programs to perform the methods disclosed herein, and a storage device 146, such as a solid-state memory, tape or hard disc for storing the determining mass and other data obtained at the processor 142. Control unit 140 can store data to the memory storage device 146 or send data to a display (not shown). In one aspect of the exemplary stimulation operation, the control unit 140 receives signals from the downhole sensors 122 and controls the various surface devices (i.e., mixing unit, pump, etc.) to obtain a selected parameter of the slurry at the downhole location. The surface devices may be controlled to obtain a selected fracture conductivity of the reservoir using the parameters of the slurry measured at the downhole sensors 122.

Fracture conductivity ($F_{CD}$) depends in part on the parameters of injection rate, pressure and proppant concentration at the downhole location. Therefore, these parameters can be controlled to obtain a selected or desired fracture conductivity. Fracture conductivity is defined as the fracture permeability $k_F$ times the average fracture width $w_{av}$ ($F_{CD}=k_f*w_{av}$). Various equations are known for relating the fracture conductivity, fracture permeability and average fracture width to the parameters of the slurry. Fracture permeability ($k_f$) depends on proppant concentration at the fracture which depends on pressure and injection rate at the fraction origin. Average fracture width ($w_{av}$) depends on the slurry injection rate as well as pressure at the fracture origin. Therefore, measurements of injection rate, pressure and proppant concentration, etc., at the downhole location can be used to estimate fracture conductivity at the reservoir. The present disclosure therefore measures these parameters at sensors 122 at the downhole location and sends the parameters to control unit 140. The control unit estimates the fracture conductivity from the measured parameters and compares the estimated fracture conductivity to a selected or desired value of fracture conductivity. The control unit may then use the comparison to determine a course of action to obtain the selected fracture conductivity and alter at least one of the injection rate, proppant concentration and pressure at the surface location accordingly. Altering the parameter of the slurry at the surface device produces a corresponding change in the parameter of the slurry at the downhole location. The parameter of the slurry at the downhole location is measured directly at sensors 122 and sent to the control unit. Thus, a closed loop for obtaining the selected fracture conductivity is used to control the stimulation operation. Additional parameters of the slurry may also be measured and controlled to obtain the selected fracture conductivity in various embodiments of the present disclosure. In alternate embodiments, any suitable reservoir parameter related to reservoir production that may be calculated from the measured parameters of the slurry can be using to control the various stimulation operations discussed herein.

Therefore, in one aspect, the present disclosure provides a method of stimulating a reservoir, including: injecting a slurry into a work string at a surface location, wherein the workstring extends from the surface location to a downhole location adjacent the reservoir; measuring a parameter of a slurry at the downhole location; estimating a fracture conductivity of the reservoir using the measured parameter of the slurry at the downhole location; and altering the parameter of the slurry at the surface location to obtain a selected fracture conductivity at the reservoir to stimulate the reservoir. A signal related to the measured parameter of the slurry is sent from the downhole location to the surface location over a fiber optic cable. The measured parameter of the slurry may be selected from a group consisting of: (i) proppant concentration; (ii) slurry pressure; and (iii) slurry injection rate. Altering the parameter of the slurry at the surface location may include at least one of: (i) altering a composition of the slurry; (ii) altering an injection rate of the slurry; and (iii) altering a pressure of the slurry; (iv) altering a pH of the slurry; and (v) altering a proppant concentration of the slurry. For a slurry that includes a proppant, the method further includes altering the parameter of the slurry at the surface location for placement of the proppant in the reservoir to obtain the selected fracture conductivity. In one embodiment, measuring the parameter of the slurry further comprises measuring the parameter of the slurry within the workstring at the downhole location.

In another aspect, the present disclosure provides an apparatus for stimulating a reservoir, including: a work string configured to extend from a surface location to a downhole location adjacent the reservoir; a device configured to provide a slurry into the work string at the surface location; a sensor at the downhole location configured to measure a parameter of the slurry at the downhole location; and a control unit configured to estimate a fracture conductivity of the reservoir using the measured parameter of the slurry and to alter the parameter of the slurry at the device to obtain a selected fracture conductivity at the reservoir to stimulate the reservoir. In one embodiment, the apparatus includes a fiber optic cable configured to provide a signal related to the measured parameter of the slurry from the downhole location to the surface location. The measured parameter of the slurry may be selected from the group consisting of: (i) proppant concentration; (ii) slurry pressure; and (iii) slurry injection rate. The control unit may be configured to alter the parameter of the slurry by performing at least one of: (i) altering a composition of the slurry; (ii) altering an injection rate of the slurry; (iii) altering a pressure of the slurry; (iv) altering a pH of the slurry; and (v) altering a proppant concentration of the slurry. For a slurry including a proppant, the control unit is further configured to alter the parameter of the slurry at the surface location for placement of the proppant in the reservoir to obtain the selected fracture conductivity. The sensor may be further configured to measure the parameter of the slurry within the work string at the downhole location.

In another embodiment, the present disclosure provides a completion system, including: a work string configured to extend from a surface location to a downhole location adjacent the reservoir; a device configured to provide a slurry into the work string at the surface location; a sensor at the downhole location configured to measure a parameter of the slurry at the downhole location; and a control unit configured to estimate a fracture conductivity of the reservoir using the measured parameter of the slurry and alter the parameter of the slurry at the device to obtain a selected fracture conductivity at the reservoir to stimulate the reservoir. The system may include a fiber optic cable configured to provide a signal related to the measured parameter of the slurry from the downhole location to the surface location. The measured parameter of the slurry is selected from the group consisting of: (i) proppant concentration; (ii) slurry pressure; and (iii) slurry injection rate. In one embodiment, the control unit is configured to alter the parameter of the slurry by performing at least one of: (i) altering a composition of the slurry; (ii) altering an injection rate of the slurry; (iii) altering a pressure of the slurry; (iv) altering a pH of the slurry; and (v) altering a proppant concentration of the slurry. For a slurry including a proppant, the control unit may be further configured to alter the parameter of the slurry at the surface location for placement of the proppant in the reservoir to obtain the selected fracture conductivity. The sensor may be further configured to measure the parameter of the slurry within the work string at the downhole location.

While the foregoing disclosure is directed to the certain exemplary embodiments of the disclosure, various modifications will be apparent to those skilled in the art. It is intended that all variations within the scope and spirit of the appended claims be embraced by the foregoing disclosure.

The invention claimed is:

1. A method of stimulating a reservoir, comprising:

injecting a slurry into a work string at a surface location, wherein the work string extends from the surface location to the reservoir, wherein the slurry includes a proppant;

using a sensor in the work string near a downhole opening of the work string adjacent the reservoir, the sensor configured to measure proppant concentration, slurry pressure and slurry injection rate of the slurry in the work string prior to delivery of the slurry from the work string to the reservoir via the downhole opening;

estimating a fracture conductivity of the reservoir using the measured proppant concentration, slurry pressure and slurry injection rate at the reservoir; and altering at least one of the proppant concentration, slurry pressure and slurry injection rate at the surface location to obtain a selected fracture conductivity at the reservoir to stimulate the reservoir.

2. The method of claim 1, further comprising sending a signal related to the measured parameter of the slurry to the surface location over a fiber optic cable.

3. The method of claim 1, wherein altering the at least one of the proppant concentration, slurry pressure and slurry injection rate at the surface location further comprises performing an operation selected from a group consisting of: (i) altering a composition of the slurry; (ii) altering an injection rate of the slurry; and (iii) altering a pressure of the slurry; (iv) altering a pH of the slurry; and (v) altering a proppant concentration of the slurry.

4. The method of claim 1, further comprising altering the at least one of the proppant concentration, slurry pressure and slurry injection rate at the surface location for placement of the proppant in the reservoir to obtain the selected fracture conductivity.

5. The method of claim 1, wherein measuring the proppant concentration, slurry pressure and slurry injection rate further comprises measuring the at least one of the proppant concentration, slurry pressure and slurry injection rate within the work string at the downhole location.

6. An apparatus for stimulating a reservoir, comprising:

a work string configured to extend from a surface location to the reservoir;

a device configured to supply a slurry including a proppant into the work string at the surface location;

a sensor in the work string near a downhole opening of the work string adjacent the reservoir, the sensor configured to measure proppant concentration, slurry pressure and slurry injection rate of the slurry in the work string prior to delivery of the slurry from the work string to the reservoir via the opening; and a control unit configured to:

estimate a fracture conductivity of the reservoir using the measured proppant concentration, slurry pressure and slurry injection rate, and alter at least one of the proppant concentration, slurry pressure and slurry injection rate at the device to obtain a selected fracture conductivity at the reservoir to stimulate the reservoir.

7. The apparatus of claim 6, further comprising a fiber optic cable configured to transmit a signal related to the measured proppant concentration, slurry pressure and slurry injection rate to the surface location.

8. The apparatus of claim 6, wherein the control unit is further configured to alter the at least one of the proppant concentration, slurry pressure and slurry injection rate by performing a function selected from a group consisting of: (i) altering a composition of the slurry; (ii) altering an injection rate of the slurry; (iii) altering a pressure of the slurry; (iv) altering a pH of the slurry; and (v) altering a proppant concentration of the slurry.

9. The apparatus of claim 6, wherein the control unit is further configured to alter the at least one of the proppant concentration, slurry pressure and slurry injection rate of the slurry at the surface location for placement of the proppant in the reservoir to obtain the selected fracture conductivity.

10. The apparatus of claim 6, wherein the sensor is further configured to measure at least one of proppant concentration, slurry pressure and slurry injection rate within the work string.

11. A completion system, comprising:

a work string extending from a surface location to a reservoir;

a device configured to supply a slurry into the work string at the surface location;

a sensor in the work string near a downhole opening of the work string adjacent the reservoir, the sensor configured to measure proppant concentration, slurry pressure and slurry injection rate of the slurry in the work string prior to delivery of the slurry from the work string to the reservoir via the opening; and a control unit configured to:

estimate a fracture conductivity of the reservoir using the measured proppant concentration, slurry pressure and slurry injection rate, and alter at least one of the proppant concentration, slurry pressure and slurry injection rate at the device to obtain a selected fracture conductivity at the reservoir to stimulate the reservoir.

12. The completion system of claim 11 further comprising a fiber optic cable configured to provide a signal related to the measured proppant concentration, slurry pressure and slurry injection rate to the surface location.

13. The completion system of claim 11, wherein the control unit is further configured to alter the at least one of the proppant concentration, slurry pressure and slurry injection rate by performing a function selected from a group consisting of: (i) altering a composition of the slurry; (ii) altering an injection rate of the slurry; (iii) altering a pressure of the slurry; (iv) altering a pH of the slurry; and (v) altering a proppant concentration of the slurry.

14. The completion system of claim 11, wherein the control unit is further configured to alter the at least one of the proppant concentration, slurry pressure and slurry injection rate at the surface location for placement of the proppant in the reservoir to obtain the selected fracture conductivity.

15. The completion system of claim 11, wherein the sensor is further configured to measure at least one of the proppant concentration, slurry pressure and slurry injection rate within the work string.

* * * * *